United States Patent [19]

Debaigt

[11] 4,040,715

[45] Aug. 9, 1977

[54] SCREW TERMINAL WITH A CAPTIVE SCREW

[75] Inventor: Jean Debaigt, Maisons Laffitte, France

[73] Assignee: Cgee Alsthom SA., Levallois-Perret, France

[21] Appl. No.: 742,136

[22] Filed: Nov. 10, 1976

[30] Foreign Application Priority Data

Nov. 26, 1975 France ..... 75.36171

[51] Int. Cl.[2] ..... H01R 9/10

[52] U.S. Cl. ..... 339/272 A

[58] Field of Search ..... 339/253, 263, 272

[56] References Cited

U.S. PATENT DOCUMENTS

| | | | |
|---|---|---|---|
| 1,711,673 | 5/1929 | Crawford et al. | 339/272 A |
| 1,955,150 | 4/1934 | Scofield et al. | 339/272 A |

FOREIGN PATENT DOCUMENTS

| | | | |
|---|---|---|---|
| 1,215,235 | 4/1966 | Germany | 339/272 A |
| 39,582 | 12/1970 | Japan | 339/272 A |

*Primary Examiner*—Joseph H. McGlynn

[57] ABSTRACT

A screw terminal disposed between two parallel partitions or cheek members, wherein the screw is held captive by retaining a neck of the screw in a keyhole of a support spring due to the fact that the screw head is restrained from lateral movement by the two cheek members.

5 Claims, 3 Drawing Figures

SCREW TERMINAL WITH A CAPTIVE SCREW

Figure 1:
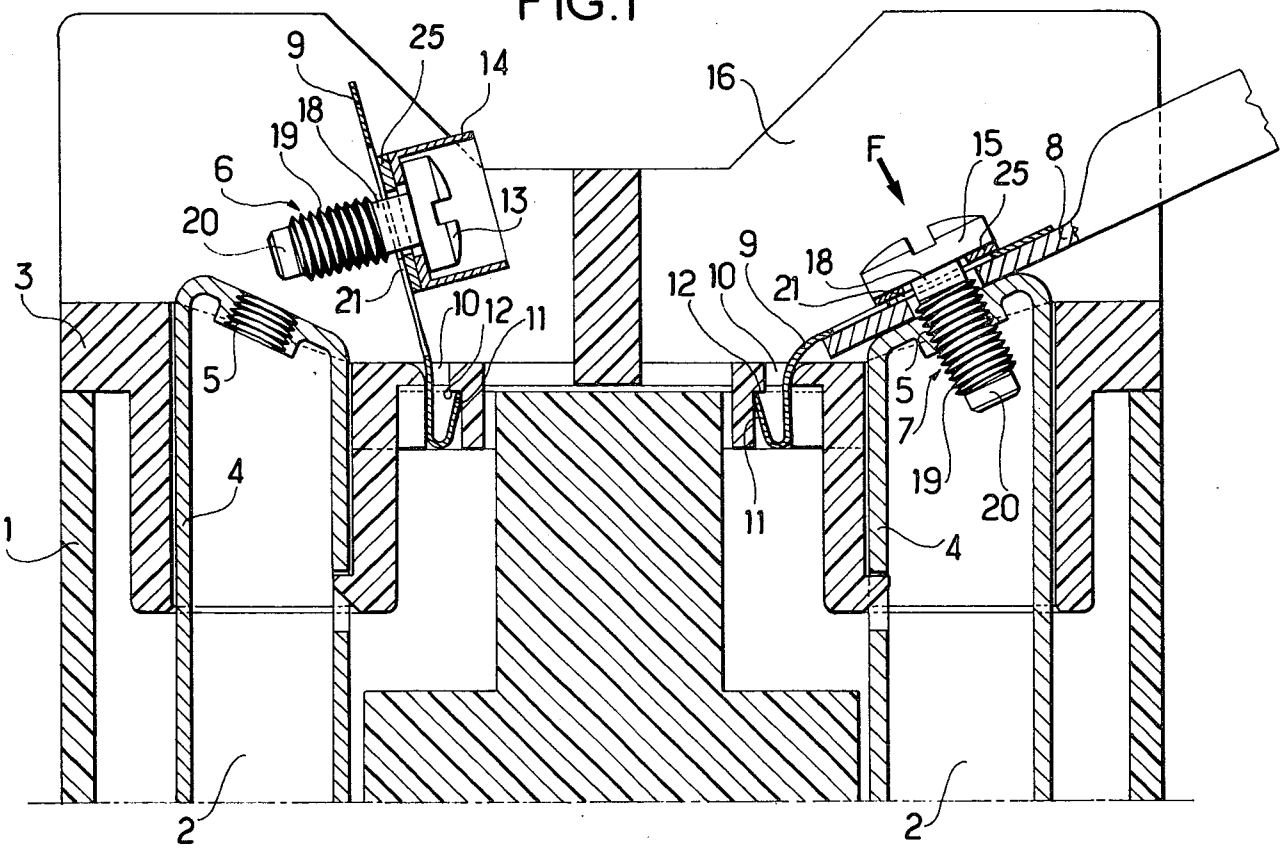

The invention relates to a screw terminal disposed between two cheeks as in the case of a terminal forming a part of a set of terminals disposed in a row in a junction block, each terminal being separated from the neighboring terminal by a partition, the partitions on either side of each terminal forming the said cheeks. The invention relates in particular to a terminal having a conductor provided with a tapped hole in which a screw is screwed to connect an eyelet terminal to the conductor. The screw is carried and held captive by a support spring.

A known disadvantage of connections with eyelet terminals is that it is necessary to separate the screw from the tapped hole to insert it through the eyelet and hence there is a risk of dropping the screw and subsequently a loss of time during assembly.

The invention eliminates this risk by holding the screw captive, which also enables the screw to be left on the terminals during transportation of a junction block or of other equipment having terminals of this type.

The present invention provides a screw terminal disposed between two cheeks and comprising a conductor provided with a tapped hole and an associated screw carried by a support spring wherein the screw has a shank and a head, the shank having a threaded portion and a neck of smaller diameter than the outside diameter of the threaded portion situated between the threaded portion and the head, the support spring being a strip of resilient material having a width substantially equal to the distance between the cheeks and having one end fixed in relation to the said conductor with the tapped hole, the support spring having a screw-retaining keyhole comprising a slot portion centrally disposed between the cheeks and parallel thereto and having a width suitable for retaining the screw by its neck, an off center portion of the same width and an end portion of sufficient diameter to receive the threaded portion of the shank, the head of the screw once in position in the slot portion being prevented by the cheeks from sideways displacement sufficient to allow to allow the screw to slide through the off center portion to the end portion.

Thus, the screw can be inserted in said keyhole as long as the support strip is not between the two cheeks, then the neck in the screw can be slid into the slot portion of the keyhole after which it is possible to position the support spring between the two cheeks, this having the effect of no longer allowing the scres to separate from the support spring since the neck of the screw is trapped in the slot portion. Simultaneously, the screw is centered and its insertion in the tapped hole is facilitated. This insertion is made even easier if the screw terminates in a guide tip of smaller diameter than the threaded hole.

The support spring can be mounted simply, by fixing the latter in a slot in the body of the terminal by a snap action.

It is advantageous to form the head of the screw by inserting a grooved part in a cup which extends transversally substantially from one cheek to the other. The cup then guides the screw between the two cheeks and these latter cannot be damaged during the screwing; further, the cup limits the tightening torque bly restricting the size of screw drivers which can be used. The cup can be constituted by a part which it independent from the screw or it can be formed from the same part as the latter by forming.

A resilient washer acting as a lock washer can be inserted between the support spring and the screw head.

Figure 2:
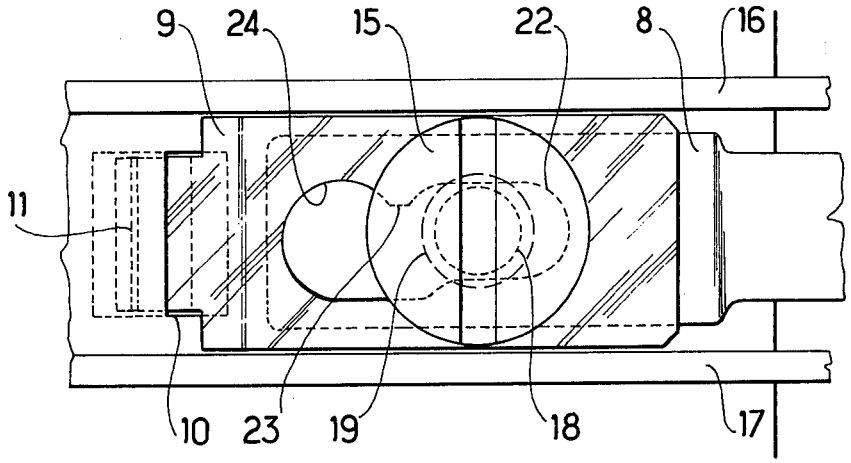
Figure 3:
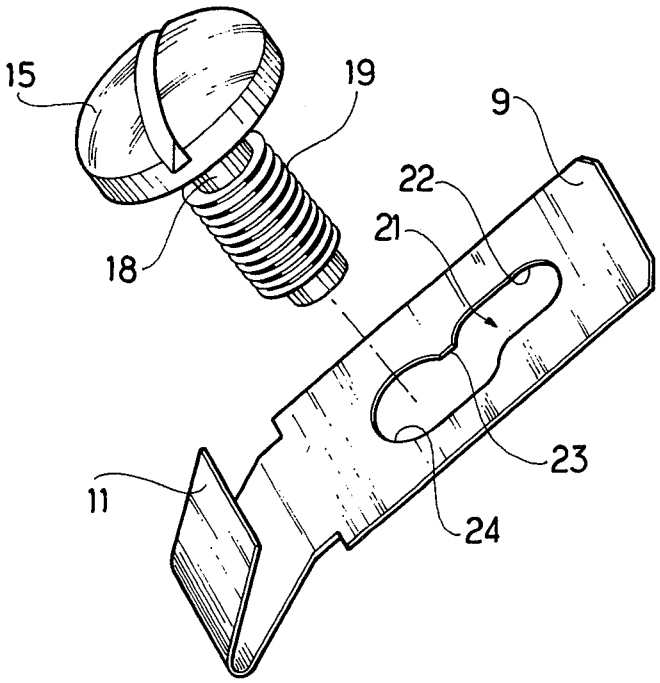

An embodiment of the invention is described by way of example with reference to the accompanying drawings, in which:

FIG. 1 is a vertical cross-section of a junction block showing terminals embodying the invention, FIG. 2 is a plan view on a larger scale of a portion of the block, taken in the direction of the arrow FI in FIG. 1, and FIG. 3 is a perspective view of a support spring and of the screw of a terminal.

With reference to FIG. 1, a junction block 1 has sockets 2 in a terminal plate 3 fitted into the block 1. Conductors 4 are fitted into the sockets 2 and are each provided with a tapped hole 5 designed to receive a screw 6 or 7 therein to retain an evlet terminal 8. The terminal on the right-hand side of the figure, has been shown with an eyelet terminal 8 mounted in place whereas the terminal on the left-hand side of the figure is open.

The screw 6 and 7 is carried by a resilient support spring 9 made of stainless steel or bronze for example and which is fixed on the terminal plate 3 by insertion in a slot 10 in the plate 3. A root portion 11 of the spring 9 is bent into a U shape which flattens out on being passed through the slot 10 and which subsequently returns to its initial shape to snap fit against an edge 12.

The head of the screw 6 consists of a slotted part 13 inserted in a brass cup 14. As an alternative the screw 7 does not carry a cup, but its slotted head 15 has the same exterior diameter as the cup 14. The strip 9 and the head 15 (or the cup 14) extend transversally approximately from one cheek 16 to an opposite cheek 17, as shown in FIG. 2 which is a partial plan view of the right-hand terminal in FIG. 1.

The screw 6 or 7 comprises, from the head downwards, a neck 18, a threaded shank 19 having a diameter greater than that of the neck 18 and a guide tip 20 having a diameter smaller than that of the threaded shank.

As shown in FIG. 3, the spring 9 has a keyhole 21 which consits of a central oblong slot 22 alinged with the axis of the spring; i.e. parallel to the cheeks 16 and 17, followed by an off-center portion 23, then by a widened portion 24, for enabling the insertion of the threaded shank 19 of the screw whereas the width of the keyhole in the zones 22 and 23 allows the neck 18 of the screw to pass, but not the threaded shank 19.

A resilient washer 25 is inserted between the support spring 9 and the screw head 15 (or cup 14), as can be seen in FIG. 1.

What we claim is:

1. A screw terminal disposed between two cheeks and comprising a conductor provided with a tapped hole and an associated screw carried by a support spring wherein the screw has a shank and a head, the shank having a threaded portion and a neck of smaller diameter than the outside diameter of the threaded portion situated between the threaded portion and the head, he support spring being a strip of resilient material having a width substantially equal to the distance between the cheeks and having one end fixed in relation to the said conductor with the tapped hole, the support spring having a screw-retaining keyhole comprising a slot portion centrally disposed between the cheeks and parallel thereto and having a width suitable for retaining the screw by its neck, an off-center portion of the same width and an end portion of sufficient diameter to receive the threaded portion of the shank, the head of the screw once in position in the slot portion being prevented by the cheeks from sideways displacement sufficient to allow the screw to slide through the off-center portion to the end portion.

2. A screw terminal according to claim 1, wherein the head of the screw has a slotted part inserted in a cup which extends transversallly substantially from one cheek to the other.

3. A screw terminal according to claim 1 wherein the said end portion of the support spring is snap fitted in a slot provided in a body of the terminal.

4. A screw terminal according to claim 1 comprising, wherein a resilient washer disposed between the support spring and the screw head.

5. A screw terminal according to claim 1 wherein the screw terminates in a guide tip having a smaller diameter than the threaded hole.

* * * * *